United States Patent [19]

Katsura et al.

[11] Patent Number: 5,024,986

[45] Date of Patent: Jun. 18, 1991

[54] HEAT SENSITIVE RECORDING PAPER

[75] Inventors: Toru Katsura; Hiroo Kaji, both of Tokyo; Kenji Hyodo, Tsuchiura; Hirokazu Ohkura, Tokyo, all of Japan

[73] Assignee: Mitsubishi Paper Mills Limited, Tokyo, Japan

[21] Appl. No.: 357,190

[22] Filed: May 26, 1989

[30] Foreign Application Priority Data

May 27, 1988 [JP] Japan ..... 63-131274

[51] Int. Cl.[5] ..... B41M 5/40

[52] U.S. Cl. ..... 503/200; 428/211; 428/537.5; 503/226

[58] Field of Search ..... 503/200, 226; 427/150–152; 428/211, 537.5

[56] References Cited

U.S. PATENT DOCUMENTS

| | | | |
|---|---|---|---|
| 4,246,312 | 1/1981 | Kosaka et al. | 428/207 |
| 4,521,793 | 6/1985 | Kabashima et al. | 503/226 |
| 4,682,191 | 7/1987 | Tamagawa et al. | 503/200 |
| 4,803,191 | 2/1989 | Tamagawa et al. | 503/200 |

FOREIGN PATENT DOCUMENTS

| | | | |
|---|---|---|---|
| 63-193881 | 8/1988 | Japan | 503/200 |
| 2111701 | 7/1983 | United Kingdom | 503/200 |
| 2114767 | 8/1983 | United Kingdom | 503/200 |

OTHER PUBLICATIONS

"Paper Structure and Properties" edited by J. A. Bristow, p. 161.

"Handbook of Physical and Mechanical Testing of Paper and Paperboard" edited by R. E. Mark, p. 411.

*Primary Examiner*—Pamela R. Schwartz

*Attorney, Agent, or Firm*—Cushman, Darby & Cushman

[57] ABSTRACT

Heat sensitive recording paper having such a thickness distribution that the average amplitude of paper thickness variation, between 0.2-mm and 1.0-mm wavelengths of paper thickness variation, does not exceed 0.5 μm and no distinctive variation peak is present in the above wavelength range.

4 Claims, 1 Drawing Sheet

EXAMPLE OF POWER SPECTRUM (SAMPLE No.2)

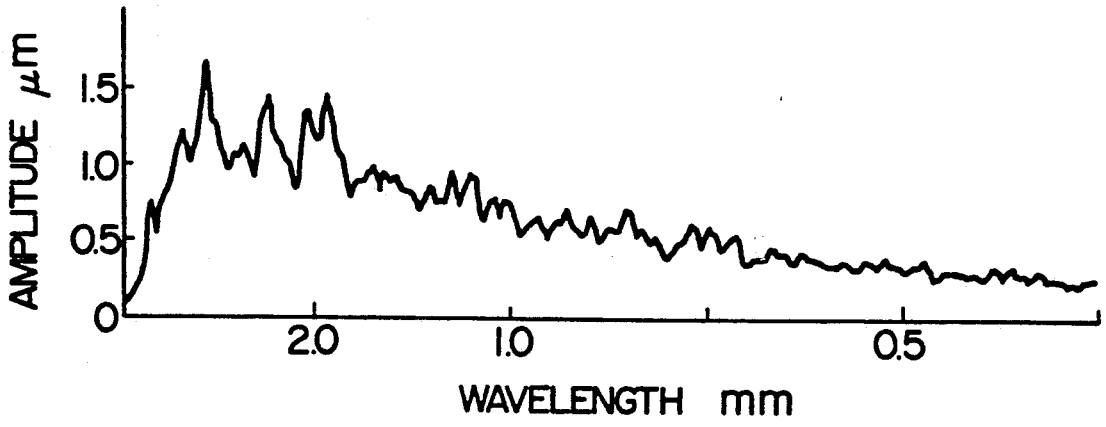

United States Patent Office

PTO - BOYERS, PA Duty Station

MISSING PAGE TEMPORARY NOTICE

PATENT # 5024986 FOR ISSUE DATE 6-18-91

HAS BEEN SCANNED, BUT WITH MISSING PAGE(S). UPON RECEIVING OF MISSING PAGE(S), THE ENTIRE DOCUMENT WILL RE RESCANNED. PLEASE CALL IMAGE DATA ADMINISTRATION STAFF OF 557-6154 IF YOU HAVE A QUESTION. ASK FOR DAVE GROOMS, ANITA YOUNG OR POLA JONES.

THIS NOTICE IS FOR THE MISSING PAGE CONTAINING:

DRAWING SHEET # 1

Data Conversion Operation

Boyers, Pa

HEAT SENSITIVE RECORDING PAPER

BACKGROUND OF THE INVENTION

1. Field of the Invention

The present invention relates to heat sensitive recording paper, i.e. thermographic recording paper, on which recording can be carried out by means of a thermal head, thermal pen, or the like, and to base paper from which said recording paper is made up.

2. Description of the Prior Art

Sheets of heat sensitive recording paper were originally applied to printers for medical purposes and instrumentation purposes and have been recently used increasingly in the fields of facsimiles and terminal image output devices. This has been attended upon a need for heat sensitive recording paper which, at high speeds of recording, exhibits higher sensitivity and provides higher quality images than does the conventional. To meet this need, a measure hitherto taken is optimizing materials for heat sensitive recording layers or optimizing the way of dispersing these materials. However, effects adequate to satisfy said need cannot be obtained with this measure alone. Hence it is practiced, as an approach through physical properties of paper, to elevate the surface smoothness of heat sensitive recording paper, thereby improving the conformity, in other words, the ability to contact intimately, of the paper with the thermal head.

Various calender treatments of heat sensitive recording paper, that is, paper coated with a heat sensitive layer, are practiced to improve the conformity of the recording paper. However, the surface smoothing of heat sensitive recording paper by calendering alone cannot sufficiently improve the conformity of the paper at the time of printing, wherein the back side of said paper is rolled out with a platen roll and is then pressed to the thermal head, and hence this type of treatment cannot provide as high sensitivity and dot reproducibility as expected.

As regards the base paper, much satisfactory paper is not obtained even when the surface smoothness is improved by calendering under proper conditions.

SUMMARY OF THE INVENTION

It is an object of the present invention to provide heat sensitive recording paper which is improved in conformity with the thermal head at the time of printing and is superior in sensitivity and dot reproducibility.

In order to achieve the above objects, the present inventors studied intensely the conformation (intimate contact state) of heat sensitive recording paper with the thermal head at the time of printing. This contact is considered to occur on the ground; even if the surface of base paper is smoothed by calendering, the thickness of base paper cannot be uniformed and hence it is infeasible to exert uniform or constant pressure on the thermal head by the platen roll through the recording paper. Thus conformity of the recording paper with the thermal head cannot be achieved.

Further, detailed investigation was made on the variation in the thickness of heat sensitive recording paper, the optical density of thermographic print on the paper and the dot reproducibility thereon. As a result, it has been found that heat sensitive recording paper superior in print density and dot reproducibility can be produced in such a manner; the average amplitude of paper thickness variation, which is regarded as a wave, between 0.2-mm and 1.0-mm wavelengths may not exceed 0.5 μm and no distinctive variation peak may be present in the above wavelength range. Thus the present invention has been completed.

The above variation in the thickness of paper can be determined by continuously measuring the thickness of paper with a differential transformer type of micrometer as described in "Paper Structure and Properties", p. 161, edited by J. A. Bristow or "Handbook of Physical and Mechanical Testing of Paper and Paperboard", p. 411, edited by R. E. Mark. The measurement is conducted by using a steel ball of 0.2 mm diameter as a testing head at a test pressure of 12 g while moving the paper specimen at a speed of 2 mm/sec.

The term "wavelength" used in the present specification means the distance between two successive points in a wave derived from frequency analysis of the thickness variation curve and the term "amplitude" means the height between a maximum point and the successive minimum point of the wave.

In practice, these values are determined by processing the signal of thickness variation with a frequency analyzer (an FFT analyzer or the like) and thereby obtaining the power spectrum.

The term "distinctive variation peak" used in the present specification means a peak having an intensity of 1.5 times or larger than that of two adjacent wavelength components in the power spectrum.

The heat sensitive recording paper of the present invention is paper overlaid with a heat sensitive layer which, on heating, develops color. This recording paper is useful as a recording material in thermal pen printers of measuring instruments, thermal printers of computer terminal units, printers for CRT image copying, thermographic facsimiles, etc.

BRIEF DESCRIPTION OF THE DRAWINGS

FIG. 1 shows a power spectrum of thickness variation for a sheet of heat sensitive recording paper pertaining to the present invention.

FIG. 2 shows a power spectrum of thickness variation for a sheet of heat sensitive recording paper pertaining to the prior art.

DETAILED DESCRIPTION OF THE INVENTION

The heat sensitive recording base paper and the heat sensitive recording paper, pertaining to the present invention, are produced by (1) using a 2-ply, 2.5-ply, or 3-ply forming fabric of fine texture, preferably made of plastic filaments, having an air permeability of up to 300 cc/cm$^2$.sec, (2) adjusting the pressure of wet press in the paper machine to such a level that the base paper after wet pressing may have a density of at least 0.8 g/cm$^3$, (3) providing a coating on one side of base paper that is opposite to the side on which a heat sensitive recording layer will be formed, thereby uniforming the thickness of the whole base paper, or (4) combining properly the above operations (1)–(3). All of the operations (1)–(3), of course, may be combined together, but this is usually unnecessary.

Forming fabric for use in the operation (1) may be those commercially available selected properly according to the purpose of the product recording paper. Optimum pressures of wet pressing depend upon the nature of raw material pulp, the type of paper machine and some other factors. Although a pressure of about 1.2 times larger than that applied in common operation provides generally a density of base paper of 0.8 g/cm$^3$, it is a matter of course that the pressure should be chosen according to results of preliminary tests for examining whether the intended density is obtained or not. The coating, in the operation (3), may be formed according to the conventional method by using a pigment and a binder which are commonly used for heat sensitive recording paper.

According to the operation stated above, the intended base paper for thermography and the intended heat sensitive recording paper can be obtained that have average amplitudes not exceeding 0.5 μm in the wavelength varied between 0.2 mm and 1.0 mm and exhibit no distinctive variation peak in the above-stated range of wavelength.

The reason why the thickness variation only in the above wavelength range brings up a problem, is considered as follows: neither the sensitivity nor the dot reproducibility is affected by any variation in the thickness that has a wavelength exceeding 1.0 mm (any such variation that the interval between two successive maximum of thickness is larger than 1.0 mm) or that has a less wavelength than 0.2 mm; because the wavelength exceeding 1.0 mm is very large as compared with the dot interval (8 dots/mm) and the thickness variation having a wavelength less than 0.2 mm is reduced by the pressure from the platen roll at the time of printing.

Average amplitudes, in the above wavelength range, exceeding 0.5 μm are undesirable, since this results in the presence of outstanding variation in the thickness within said range, e.g., no conformability, making it impossible to achieve sufficient print density and good reproducibility of dots in printing.

The base paper for heat sensitive recording paper, according to the present invention, is produced from materials which are chosen on demand from ordinary raw materials of paper such as wood pulp, synthetic pulp, fillers, sizing agents, paper reinforcing agents, and dyes.

A coating comprising an oil-absorbing pigment can be provided on the surface of base paper to improve the compressibility, heat retentivity and some other properties.

The heat sensitive recording paper of the present invention may have any of known heat sensitive recording layers of the leuco dye type, light-fixable diazo type, metal salt type, antifading type, etc.

For example, suitable heat sensitive recording layers are as follows: A leuco dye type as described in JAP-A-57-87995, a light-fixable diazo type as described in JAP-A-57-120591, a metal salt type as described in JAP-A-62-284782 and an antifading type as described in JP-A-63-193881.

Preferred recording layers are of the leuco dye type and the antifading type in view of their versatility and performance characteristics.

For the heat sensitive recording paper of the present invention, the heat sensitive recording layer can be formed by using known coating methods including blade coating, air knife coating, gravure coating, roll coating and bar coating. Further an over coating can be provided to protect the heat sensitive recording layer.

EXAMPLE

The present invention is illustrated in more detail with reference to the following examples, which are not construed to restrict the scope of the invention. In these examples, parts and percentages (%) are all by weight. Coating weights therein are on the dry basis unless noted.

EXAMPLE 1

Base paper having the basis weight of 45 g/m$^2$, the density of 0.80 g/cm$^3$ and the Beck smoothness of 90 seconds was prepared by beating 30 parts of needle-leaf tree kraft pulp and 70 parts of broad-leaf tree kraft pulp up to a Canadian standard freeness of 200 ml, adding 10 parts of precipitated calcium carbonate (tradename TP-121, manufactured by Okutama Kogyo Co., Ltd.), 2 parts of cationic starch (tradename Cato F, manufactured by Oji-National Co., Ltd.) and 0.2 part of a neutral sizing agent (tradename Hercon W, manufactured by Dick-Hercules Co., Ltd.) and processing the resulting slurry in a longscreen paper machine using a 3-ply woven plastic wire (tradename TT-5000, manufactured by Nippon Filcon Co., Ltd. air permeability 165 cc/cm$^2$.sec). The resulting base paper was coated with 3.5 g/m$^2$ of oxidized starch by using a size press.

The opposite side of the base paper was coated with a coating dispersion for an intermediate layer, prepared in Preparation Example 1 which is described later, by using a blade coater to give a coating weight of 8 g/m$^2$ and with a heat sensitive coating dispersion prepared in Preparation Example 2 by using an air knife coater to give a coating weight of 3 g/m$^2$ successively. The thus prepared paper having a heat sensitive recording layer was supercalendered so that the heat sensitive recording surface might have a Beck smoothness of 300 to 400 seconds and a heat sensitive recording material is given. This recording material is designated as Sample No. 1.

EXAMPLE 2

Base paper having the basis weight of 45 g/m$^2$ was prepared by processing the same compound slurry of materials for paper as used in Example 1 with a longscreen paper machine using a bronze wire (tradename LV 70, manufactured by Nippon Filco Co., Ltd.). In this case, the line pressure of wet press was varied, thereby two different types of base paper having a density of 0.80 g/cm$^3$ (Beck smoothness 80 seconds) and a density of 0.85 g/cm$^3$ (Beck smoothness 100 seconds) were given, respectively.

These different types of base paper were treated according to the procedure of Example 1; and two heat sensitive recording materials were given. These recording materials are designated as Sample Nos. 2 and 3.

COMPARATIVE EXAMPLE 1

A heat sensitive recording material was prepared according to the procedure of Example 2 except that the density of base paper was controlled to 0.75 g/cm$^3$ by reducing the line pressure of wet press. This recording material is designated as Sample No. 4.

EXAMPLE 3

A heat sensitive recording material was prepared according to the procedure of Example 1 except that the back side of base paper prepared in Comparative Example 1 was coated with an intermediate coating dispersion prepared in Preparation Example 1 by using a blade coater to give a coating weight of 3 g/m$^2$. This recording material is designated as Sample No. 5.

COMPARATIVE EXAMPLE 2

A heat sensitive recording material was prepared from paper coated with a heat sensitive layer in Comparative Example 1 by supercalendering with relatively high line-pressed; thereby the Beck smoothness of heat sensitive surface was raised from about 350 seconds, which is the usual value, to 620 seconds. This recording material is designated as Sample No. 6.

COMPARATIVE EXAMPLE 3

A heat sensitive recording material was prepared according to the procedure of Example 1 except that the line pressure of wet press was reduced to give a base paper density of 0.73 g/cm$^3$. This recording material is designated as Sample No. 7.

COMPARATIVE EXAMPLE 4

Base paper, having the density of 0.75 g/cm$^3$, prepared in Comparative Example 1 was machine-calendered so as to raise its density up to 0.85 g/cm$^3$ (Beck smoothness: 180 seconds). This base paper was processed according to the procedure of Example 1; and a heat sensitive recording material was given. This recording material is designated as Sample No. 8.

PREPARATION EXAMPLE 1

A coating dispersion for intermediate layer purposes was prepared by stirring a mixture of the following composition:

| | |
|---|---|
| Burnt kaolin (Ansilex ®, manufactured by Engelhard Minerals & Chemicals Corp.) | 100 parts |
| Styrene-butadiene copolymer latex (50% aqueous dispersion) | 24 parts |
| Phosphate-esterified starch (MS-4600, manufactured by Nippon Shokuhin-Kako Co., Ltd. 10% aqueous solution) | 60 parts |
| Water | 52 parts |

PREPARATION EXAMPLE 2

A liquid [A] and a liquid [B] were prepared from mixtures of the following respective compositions by sand-milling to an average particle diameter of about 5 μm.

| | |
|---|---|
| Composition for liquid [A]: | |
| 3,3-Dibutylamino-6-methyl-7-anilinofluoran | 40 parts |
| 10% Aqueous solution of polyvinyl alcohol | 20 parts |
| Water | 40 parts |
| Composition for liquid [B]: | |
| Bisphenol A | 50 parts |
| Benzyloxynaphthalene | 50 parts |
| 10% Aqueous solution of polyvinyl alcohol | 50 parts |
| Water | 100 parts |

Subsequently, a heat sensitive coating dispersion was prepared by mixing liquids [A] and [B] and other ingredients in the following proportions:

| | |
|---|---|
| Liquid [A] | 50 parts |
| Liquid [B] | 250 parts |
| Zinc stearate (40% dispersion) | 25 parts |
| 10% Aqueous solution of polyvinyl alcohol | 216 parts |
| Calcium carbonate | 50 parts |
| Water | 417 parts |

Results of experiments in the above examples are summarized in Table 1.

TABLE 1

| | Sample No. | Amplitude (μm) of thickness variation in wavelength range from 0.2 to 1.0 mm | Distinctive variation peak | Beck smoothness (sec) | Print density (O.D.) | Dot reproducibility |
|---|---|---|---|---|---|---|
| Example 1 | 1 | 0.3 | Absent | 350 | 0.96 | ⊙ |
| Example 2 | 2 | 0.5 | Absent | 330 | 0.80 | ○ |
| Example 2 | 3 | 0.4 | Absent | 380 | 0.85 | ○ |
| Comparative Example 1 | 4 | 0.8 | Present | 350 | 0.63 | X |
| Example 3 | 5 | 0.4 | Absent | 330 | 0.88 | ○ |
| Comparative Example 2 | 6 | 0.6 | Present | 620 | 0.75 | X |
| Comparative Example 3 | 7 | 0.7 | Absent | 340 | 0.73 | X |
| Comparative Example 4 | 8 | 0.7 | Present | 360 | 0.65 | X |

Dot reproducibility:
⊙ excellent,
○ good,
X bad.

Print densities shown in Table 1 were determined as follows: Dots were printed on samples of heat sensitive recording paper by using a GIII facsimile tester (Model TH-PMD, supplied by Okura Denki Co., Ltd.) and applying power for 0.6 μm second and then the reflective optical densities of printed dots were measured by using a Macbeth densitometer (Model RD-918). Heat sensitive recording paper needs to have a sensitivity of at least 0.8 in terms of the print density.

It is evident from Table 1: such heat sensitive recording paper that the average amplitude of the thickness variation in the wavelength varied between 0.2 and 1.0 mm does not exceed 0.5 mm and no distinctive variation peak is present in the above wavelength range, exhibits high print density and superior dot reproducibility regardless of the smoothness of its heat sensitive recording surface.

What is claimed is:

1. Heat sensitive recording paper comprising a heat sensitive recording layer which, upon heating, develops color, wherein the average amplitude of paper thickness variation in the range of 0.2-mm and 1.0-mm wavelengths of paper thickness variation does not exceed 0.5 μm and wherein said paper has no distinctive variation peak in the above wavelength range.

2. Heat sensitive recording paper according to claim 1, wherein said paper further comprises an oil-absorbing pigment layer interposed between a surface of a base paper for said recording paper and a heat-sensitive recording layer and wherein the intensity of any variation peak does not exceed 1.5 times the intensity of adjacent wavelength components in the power spectrum.

3. Heat sensitive recording paper according to claim 1, wherein the heat sensitive recording layer of the recording paper comprises a leuco dye.

4. Heat sensitive recording paper according to claim 1, wherein the average amplitude of paper thickness variation in the range of 0.2-mm and 1.0-mm thickness of paper variation does not exceed 0.3 μm.

* * * * *